United States Patent [19]

Barbakadze et al.

[11] 4,135,920

[45] Jan. 23, 1979

[54] METHOD OF INTRODUCING POWDERED MATERIAL INTO MOLTEN METAL

[76] Inventors: Dzhondo F. Barbakadze, ulitsa Gyadanskaya, 6, kv. 35, Tbilisi; Frants F. Zamechnik, poselok Metallurgov, 116, Volgograd; Vladimir F. Popov, ulitsa Sovetskaya, 11, kv. 23, Volgograd; Pavel A. Bykov, prospekt imeni Lenina, 179, kv. 83, Volgograd, all of U.S.S.R.

[21] Appl. No.: 702,409

[22] Filed: Jul. 6, 1976

[51] Int. Cl.[2] ..... C22C 33/08

[52] U.S. Cl. ..... 75/130 R; 75/130 B; 75/130 BB

[58] Field of Search ..... 75/53, 130 R, 130 B, 75/130 BB

[56] References Cited

U.S. PATENT DOCUMENTS

| | | | |
|---|---|---|---|
| 2,776,206 | 1/1957 | Klingbeil | 75/130 R |
| 2,803,533 | 8/1957 | Bieniosek | 75/130 R |
| 3,322,530 | 5/1967 | Nakamura | 75/130 R |
| 3,357,692 | 12/1967 | Bakkerus | 75/130 R |
| 3,367,646 | 2/1968 | Robertson | 75/130 R |
| 3,410,679 | 11/1968 | Pardo | 75/129 |
| 3,514,285 | 5/1970 | Bakkerus | 75/130 R |

*Primary Examiner*—P. D. Rosenberg

*Attorney, Agent, or Firm*—Lackenbach, Lilling & Siegel

[57] ABSTRACT

A method of introducing powdered material into molten metal by means of a carrier stream of gas passing through a metal tube having a closed free end melting or, said end fusing at the instant the tube is immersed into the molten metal. On completion of introducing the powdered material, pressure of the carrier stream of gas is decreased to reach essentially the ferrostatic pressure of the molten metal.

7 Claims, No Drawings

METHOD OF INTRODUCING POWDERED MATERIAL INTO MOLTEN METAL

The present invention relates to the metallurgical industry and more particularly to foundry practices and specifically to a method of introducing powdered material into molten metal.

The invention may prove to be most advantageous in producing cast iron and steel.

It may be also particularly useful for the production of non-ferrous metals.

In order to enhance the quality of metal various powdered materials are introduced into the melt by means of a carrier stream of gas.

Powdered materials are fed into molten metal by means of a carrier stream of gas at a preset pressure that exceeds the ferrostatic pressure of the molten metal with the ensuing bubbling of the melt which increases the probability of intimate contact between the particles of the powdered material and those of the molten metal. It also provides a several-fold increase in the coefficient of assimilation of the elements incorporated in the composition of the powders by the molten metal as compared with the melt inoculation with a pig metallic magnesium or its master alloys.

Thus, the efficiency of using powdered magnesium in comparison with pig metallic magnesium is also stipulated by that the powdery particles are more likely to come in contact with the molten metal and to remain in the melt over a greater period of time, insofar as the rate of floating up of the powdered materials depends on the size of powder grains.

At present with a view to enhancing the quality of metal various powdered materials are introduced into its melt.

Refining of molten metal is effected by means of calcium, magnesium and soda ash powders introduced thereinto to remove sulphur and phosphorus harmful impurities.

Powdered calcium carbide, cryolite and other materials introduced into molten cast iron increase its temperatures due to exothermal reactions proceeding therein.

Introducing of powdered magnesium, cerium, silicocalcium and the like leads to inoculation of cast iron by altering the shape of graphite inclusions which improves mechanical characteristics of final products produced therefrom.

Microalloying of cast iron and steel with powdered titanium, boron and other elements provides high quality of final products.

Powdered materials may be introduced into molten metal by various procedures.

Known in the art is a method of introducing powdered magnesium into molten cast iron by injecting it with a compressed inert gas (nitrogen or carbon dioxide) into a Bessemer converter through a graphite tube.

Molten cast iron is poured into the converter prior to feeding powdered magnesium therein.

To preclude a decrease in the temperature of molten cast iron which may result from inoculation with magnesium, the melt is preliminary blown through in the converter with compressed air by the Robert or Tropenas process, to raise the temperature of the molten metal by 120–150° C. due to exothermal reaction.

By said method powdered magnesium can be easily introduced into molten cast iron.

The Bessemer converter is provided with an exhaust ventilation and so it is possible to obviate pyro-effect and intense smoking in the working premises which take place when introducing pig metallic magnesium into the molten cast iron in open teeming ladles.

Six method allows also enhancing the coefficient of assmilation of magnesium by molten cast iron.

Moreover, the above method simplifies inoculation of molten case iron with magnesium and does not involve special sealed vessels or ladles.

However, since with the above procedure molten cast iron is preliminary blown with compressed air, the iron oxidizes, its deoxidation requiring thereby a large amount of magnesium, in view of which magnesium comsumption when using said method is very great.

The above method requires also the use of a Bessemer converter.

Known in metallurgy is also a method of introducing powder ed material into molten cast iron by means of a carrier stream of gas through a high-temperature steel tube (tuyere). The tuyere 6 m. high and 400–600 mm. in diameter is made multilayer.

70–90 t. of molten cast iron is poured into an open-type ladle wherein the tuyere is lowered by a winch.

After that powdered material is introduced into the molten cast iron with the air of compressed air under a pressure of 5–6 atm. to effect deep desulphuration of the metal.

Desulphuration by the above method can provide maximum sulphur contents in cast iron of from 0.01 to 0.02% by weight.

Moreover, said method makes it possible to employ air compressed in a compressor as a gas carrier, this being the most inexpensive and easily available gas carrier.

Yet, in spite of efficient desulphuration of cast iron by said method, it involves the fabrication of a multilayer tuyere which is a very labor consuming operation.

Moreover, the introduction of said tuyere into molten cast iron requires a winch which should be mounted at a height of 12–15 m., and this requires the construction of a trestle.

To preclude the clogging of the tuyere opening with powder ed materials a carrier gas pressure of at least 5–6 atm must be maintained during their introduction into the melt which causes splashing of molten metal from the ladle.

Also known in the art is a method of introducing a powdered mixture of magnesium and lustrous (silvery) graphite into molten metal by means of a carrier stream of gas.

The molten metal is poured into a rotating drum ladle. A ceramic sleeve or lining accommodating a metal tube is inserted into the ladle.

The molten metal is poured into the ladle to the ceramic sleeve level.

Then a flexible hose connected to a hopper with the powdered mixture is connected to the metal tube.

To introduce the powdered mixture the ladle is placed into a chamber furnished with an exhaust system. Compressed air is fed into the ladle through the flexible hose and the metal tube, the ladle being turned for that purpose so that the ceramic sleeve together with the built-in metal tube submerges into the lower layers of the molten metal.

Following that a clock on the hopper with the powdered mixture is open, the mixture being introduced into the melt with a stream of compressed air. Upon introducing a preset amount of the powdered mixture into the molten metal, the cock is closed and the ladle is returned into its initial position. Next the valve admitting the compressed air is closed and the flexible hose is disconnected from the metal tube.

Said method allows producing high-strength cast iron that features a high magnesium utilization coefficient, and obviating atmospheric pollution in the shop with gases released during inoculation.

Moreover, the above procedure enables the production of high-strength case iron in any amount needed and with a desired residual magnesium content in a final product.

However, in spite of the above-mentioned advantages of said method, the repairs of the drum ladles present a problem.

It also involves the use of a special chamber provided with an exhaust system.

When using said method the scope of crane operations increases and the total time of inoculation of molten metal is extended.

Known also in the art is a method of introducing powdered magnesium into molten cast iron by means of a nitrogen stream admitted from a three-way valve.

Powdered magnesium is fed through a flange-diffuser and a graphite tube directly into a molten cast iron bath.

Said method can be effected in a forehearth connected through a communicating taphole to a cupola.

Built-in into a forehearth wall are graphite contacts determining a requisite level of cast iron to be inoculated.

With the above procedure powdered magnesium is introduced with the aid of a nitrogen stream into the bottom layers of molten cast iron through the graphite tube that is stationary and horizontally fixed in the forehearth wall. As soon as the preset amount of powdered magnesium is introduced thereinto, its supply is out off and the blast is switched over from nitrogen to air or oxygen.

Since the process is carried out in a closed forehearth, pyro-effect as well as the splashing of molten metal and atmospheric pollution with flue gases are avoided.

The flue gases released during the process flow through the communicating taphole into the cupola from which they are removed together with fuel combustion products.

As the flue gases pass through coke-metallic layers of a cupola charge loaded therein, the main product of inoculation MgO precipitates on coke and is adsorbed on its surface, by which virtue the amount of MgO released to the atmosphere diminishes materially.

However, though the process of inoculation of molten cast iron is automated and cast iron produced has a uniform composition, said method does not enable periodic operation of the installation.

Moreover, the gas carrier must be continually fed into the forehearth with molten cast iron because as soon as its supply is discontinued, the molten cast iron flows by gravity into the graphite tube and freezes solid therein, resulting in its failure. At the same time a continuous supply of the carrier gas (air or oxygen) changes the chemical composition of the cast iron and results in wearing away of the graphite tube.

The main object of the present invention is to provide a method of introducing powdered material into molten metal which would enable periodic supply of the powdered material and carrier gas.

Another no less important object of the present invention is the provision of said method of introducing the powdered material into molten metal which would enhance the quality of metal produced as compared with similar prior-art procedures.

Still another object of the invention is the provision of a method similar to the above-outlined which would preclude tube clogging with the powdered material.

These and other objects are achieved by providing a method of introducing powdered material into molten metal by means of a carrier stream of gas, wherein, according to the invention, the introduction of the powdered material by means of the stream of gas is performed through a metal tube having an open end which is closed by clogging due to fusion of said end, specifically, said end melting or fusing at the instant the tube is immersed into the molten metal and on completion of introducing the powdered material when pressure of the stream of gas is decreased to reach essentially the ferrostatic pressure of the molten metal.

Since, according to the invention, the powdered material is introduced by means of the carrier stream of gas through the metal tube having an open end through which powdered material is blown into molten melt and which end fused off as, at the tube is immersed into the melt, and the pressure is reduced, said method ensures periodic supply of the powdered material into the molten metal.

Moreover, since on completion of introducing the powdered material, pressure of the carrier stream of gas is decreased essentially to the ferrostatic pressure of the molten metal, it is possible to stop the continuous supply of the gas carrier into the forehearth with the molten metal and, hence, to improve the quality of the metal produced in comparison with the similar prior-art methods, and to preclude tube clogging with the powdered material.

The proposed method of introducing powdered material into molten metal is accomplished in the following manner.

A refractory sleeve is built-in into the lining of the side wall of the forehearth connected through the communicating taphole with the cupola. The metal tube provided with a closed end is introduced into the sleeve. The other end of the tube is connected with the aid of a meta hose to a feed hopper accommodating the powdered material.

As soon as a certain amount of the molten metal is accumulated in the forehearth, where it is admitted from the cupola, the metal tube is immersed into the melt; and at the same time a carrier stream of gas at a pressure of 2–3 atm. is fed thereinto.

When the metal tube is immersed into the molten metal, its clogged or closed end melts or fuses off and the gas carrier is supplied into the melt.

Then a cock on the feed hopper opens and the powdered material is introduced into the molten metal by means of the carrier stream of gas.

Upon introducing a preset amount of the powdered material, the feed-hopper cock closes and the supply of the powdered material is cut off.

On completion of introducing the powdered material pressure of the stream of gas is decreased to reach essentially the ferrostatic pressure of the molten material. As soon as this pressure is attained, a small amount of molten metal flows into the end of the metal tube and freezes or solidifies solid therein, plugging said end.

From that moment the gas carrier supply to the molten metal is cut off.

The molten inoculated metal is tapped into a ladle, a new batch of molten metal being continually admitted from the cupola into the forehearth.

As soon as a preset amount of the molten metal is accumulated in the forehearth, said operations are repeated. This enables periodic supply of the powdered material into the molten metal.

Moreover, a continuous supply of the gas carrier into the molten metal is obviated, a feature which improves substantially the quality of inoculated metal being produced as compared with the prior-art methods of the type described.

Given hereinbelow are the exemplary embodiments illustrating the proposed method of introducing powdered material into molten metal.

EXAMPLE 1

Built-in into the lining of a side forehearth wall 200 mm above the forehearth bottom is a graphite sleeve in which is inserted a steel tube 1500 mm long and with an inside diameter of 10 mm having a clogged or closed end. The other end of this tube is connected by means of a metal hose to a feed hopper accomodating a powdered magnesium.

After the cupola starts operating and upon accumulating in the forehearth a preset amount of molten cast iron, whose level is indicated by a call lamp coupled with graphite contacts arranged in the forehearth wall, the steel tube is immersed into the molten cast iron. At the same time a stream of compressed air at a pressure of 2–3 atm is fed therein.

When the tube is immersed into the molten cast iron, its clogged or closed end melts or fuses and compressed air is admitted into the molten cast iron.

Following that an actuating mechanism opens a feed hopper cock and 30 kg of the powdered magnesium are introduced during 6 min by means of a stream of compressed air into the molten cast iron.

Then the feed hopper cock is closed and the supply of the powdered magnesium into the molten cast iron is cut off.

As soon as the introduction of the powdered magnesium is discontinued, the comressed air stream pressure is decreased from 3 atm. to 1 atm, with a small amount of molten cast iron flowing into the end of the steel tube, freezing solid for 1 min. and plugging the tube.

Following that the molten cast iron is held in the forehearth for 5 min. to enable nonmetallic inclusions to float up. Then inoculated cast iron is discharged into a ladle.

The cast iron produced by the proposed method is free from nonmetallic inclusions, since the molten cast iron is tapped on the level of the foreheath bottom.

In this case the specific consumption of the powdered magnesium is 3 kg per 1 t of molten cast iron.

EXAMPLE 2

A graphite sleeve is built-in into the foreheath side wall 1500 mm above the forehearth bottom. The sleeve accommodates a steel tube 1500 mm long with an inside diameter of 12 mm, having a clogged end closed.

The other end of the tube is connected through a metal hose to a feed hopper containing powdered magnesium.

The method of introducing powdered magnesium into molten cast iron is similar to that described in Example 1.

40 kg of powdered magnesium are fed into the molten cast iron with the aid of a stream of compressed air for 5 min.

On completion of supply of both the powdered magnesium and compressed air into the molten cast iron, the latter is held in the forehearth for 4 min. to enable nonmetallic inclusions to float up. Then inoculated cast iron is discharged into a ladle.

The cast iron inoculated by the proposed method is particularly useful for producing castings for the machine-building industry and in making molds.

In this case the specific consumption of powdered magnesium amounts to 4 kg per 1 t of molten cast iron.

EXAMPLE 3

A graphite steel is built in the lining of a side forehearth wall 100 mm above the forehearth bottom. The sleeve accommodates a steel tube 1500 mm long with an inside diameter of 14 mm, having a clogged or closed end. The other end of the tube is connected with the help of a metal hose to a feed hopper containing powdered magnesium.

The method of introducing powdered magnesium into molten cast iron is similar to that described in Example 1.

50 kg of the powdered magnesium are fed into the molten cast iron with the aid of a stream of compressed air for 4 min.

On completion of supply of both the powdered magnesium and compressed air into the molten cast iron, the latter is held in the forehearth for 3 min., to enable nonmetallic inclusions to float up. After that inoculated cast iron is discharged into a ladle.

WHat we claim is:

1. A method of feeding additive materials into a batch or preset amount of molten metal in a closed vessel by means of a tube and a carrier stream of gas; comprising the steps of: employing an open ended tube which is closed at its immersed end by clogging due to fusion of said end; continuously feeding said carrier stream of gas into said tube while introducing a predetermined amount of said material into said tube so as to be carried into said molten metal by said carrier gas; and subsequently reducing the pressure of said carrier gas to that of the ferrostatic pressure of the molten metal, so that said molten metal flowing into the open end of said tube freezes solid and plugs said end thereby cutting off the flow of said carrier gas; whereby upon increasing the pressure of said carrier gas in said tube, said end is fused off thus precluding the need to remove said tube from said molten metal and permitting materials if required to be fed again into said molten metal.

2. The method according to claim 1, wherein said method steps are repeated for each separate batch of molten metal, whereby periodic supplying of said material to said batches of molten metal eliminates the need for a continuous supply of said carrier gas and improves the quality of the metal.

3. The method according to claim 1, wherein compressed air is employed as said carrier gas.

4. The method according to claim 3, wherein said molten metal is cast iron.

5. The method according to claim 4, wherein said compressed air is at a pressure of 2–3 atmospheres.

6. The method according to claim 5, including introducing powdered magnesium into said molten cast iron by said compressed air for a period of about 6 minutes, and thereafter decreasing the pressure of said compressed air to about one atmosphere so that a small amount of said molten cast iron flows into the open end of said tube and freezes solid, thereby plugging said tube until said method is repeated.

7. The method according to claim 3, wherein said tube is made of steel.

* * * * *